US005907751A

United States Patent [19]

Kawaguchi et al.

[11] Patent Number: 5,907,751

[45] **Date of Patent: *May 25, 1999**

[54] PROCESS CARTRIDGE WITH MOUNTING PROJECTIONS AND IMAGE FORMING APPARATUS USING SUCH A PROCESS CARTRIDGE

[75] Inventors: Hideshi Kawaguchi, Yokohama; Yoshiya Nomura, Tokyo, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/578,337

[22] Filed: Dec. 26, 1995

[30] Foreign Application Priority Data

Dec. 26, 1994 [JP] Japan ..... 6-322294

[51] Int. Cl.[6] ..... G03G 15/00

[52] U.S. Cl. ..... 399/117; 399/111

[58] Field of Search ..... 399/110, 111, 399/116, 117, 119

[56] References Cited

U.S. PATENT DOCUMENTS

| | | | |
|---|---|---|---|
| 4,084,901 | 4/1978 | Aasen et al. | 399/116 X |
| 4,674,858 | 6/1987 | Nagayama | 399/116 |
| 4,839,690 | 6/1989 | Onoda et al. | 399/117 |
| 5,331,373 | 7/1994 | Nomura et al. | 355/200 |
| 5,345,294 | 9/1994 | Nomura et al. | 355/200 |
| 5,452,056 | 9/1995 | Nomura et al. | 355/200 |
| 5,543,891 | 8/1996 | Setoriyama | 399/111 |
| 5,559,589 | 9/1996 | Eichberger et al. | 399/119 |

*Primary Examiner*—Fred L. Braun
*Attorney, Agent, or Firm*—Fitzpatrick, Cella, Harper & Scinto

[57] ABSTRACT

A process cartridge detachably mountable to a main assembly of an electro-photographic image forming apparatus including a cartridge frame; an electro-photographic photosensitive drum; processing device actable on the electro-photographic photosensitive drum; a first projection projecting outward from one of opposite ends of the cartridge frame, coaxial with the electro-photographic photosensitive drum; a second projection projecting outward from the other of the opposite ends of the cartridge frame, coaxial with the electro-photographic photosensitive drum; wherein the first and second projections are different in size.

36 Claims, 12 Drawing Sheets

PROCESS CARTRIDGE WITH MOUNTING PROJECTIONS AND IMAGE FORMING APPARATUS USING SUCH A PROCESS CARTRIDGE

FIELD OF THE INVENTION

The present invention relates to a process cartridge and an electro-photographic image forming apparatus, which forms images using an electro-photographic system.

DESCRIPTION OF THE RELATED ART

In an image forming apparatus such as a printer, the surface of an electro-photographic photosensitive member, which is uniformly charged by a charging device, is selectively exposed to form a latent image. The latent image is visualized with developer using a developing device, and the image formed of the developer is transferred onto a recording medium to produce a copy of the original image. Generally speaking, image forming apparatuses have had to be maintained by service personnel.

Therefore, it has been desired to simplify the maintenance of the image forming apparatus so that the users themselves can maintain the apparatus. Such a desire has been realized by the introduction of a process cartridge, which integrally comprises the aforementioned electro-photographic photosensitive member, charging device, and developing device, a cleaning section, and the like. With the employment of the process cartridge, the users can replenish the developer, or replace components such as the electro-photographic photosensitive member, the service lives of which have expired, simply by exchanging the cartridge.

Referring to FIG. 13, the process cartridge is provided with guide projections 52*a* and 52*b*, which are used to insert the process cartridge into the main assembly of the image forming apparatus. They project form the corresponding lateral surfaces of a cartridge frame 51, and are coaxial with the electro-photographic photosensitive member 50, which requires the utmost positional accuracy relative to the main assembly of the image forming apparatus. When a process cartridge 55 is inserted into the apparatus main assembly 53, these guides projections 52*a* and 52*b* follow guide portions 54*a* and 54*b* provided in the left and right walls of a cartridge accommodating space of the apparatus main assembly 53, respectively.

However, in the case of a conventional process cartridge, both guide projections 52*a* and 52*b* are the same in shape and size, and also are symmetrically disposed. In addition, the guide portions 54*a* and 54*b* of the apparatus main assembly, in which the process cartridge 55 is inserted, are also symmetrical. Therefore, it is conceivable that the process cartridge 55 is liable to be inserted in reverse, as shown in FIG. 13(*b*), into the apparatus main assembly 53, with partial success, instead of being correctly inserted as shown in FIG. 13(*a*).

SUMMARY OF THE INVENTION

Accordingly, a primary object of the present invention is to provide a process cartridge, which can be only correctly inserted into an image forming apparatus, and an image forming apparatus, which can accommodate only a correctly oriented process cartridge.

Another object of the present invention is to provide a process cartridge, which can be inserted into an image forming apparatus, with improved efficiency, and an image forming apparatus, which can accommodate the process cartridge, with improved efficiency.

According to an aspect of the present invention, a process cartridge comprises: first and second projections, which are coaxial with an electro-photographic photosensitive drum, and project outwardly from the corresponding lateral surfaces of a cartridge frame, wherein the first and second projections are different in size.

These and other objects, features and advantages of the present invention will become more apparent upon a consideration of the following description of the preferred embodiments of the present invention, taken in conjunction with the accompanying drawings.

DESCRIPTION OF THE PREFERRED EMBODIMENTS

Hereinafter, preferable embodiments of the present invention will be described with reference to the drawings.

The process cartridges described in the following embodiments are removably installed in an image forming apparatus, and comprise: an electro-photographic photosensitive member; a minimum of one processing means actable on the electro-photographic photosensitive member; a cartridge frame, which supports the electro-photographic photosensitive member, and processing means; and first and second guide projections, which project from the corresponding lateral surfaces of the cartridge frame, and serve as the guides when the process cartridge is installed in the image forming apparatus; wherein the first guide projection is rendered larger than the second guide projection.

The image forming apparatuses in the following embodiments comprise an accommodating means for accommodating the process cartridge, a transferring means for transferring the image formed on the electro-photographic photosensitive image onto the recording medium, and a conveying means for conveying the recording medium; wherein the accommodating means is provided with first and second openings, through which the first and second guide projections of the process cartridge are inserted, respectively, and the second opening is narrower than the first guide projections of the process cartridge.

Since the configuration of the guide projection is different between one side of the cartridge frame and the other side thereof, when the process cartridge is inadvertently held in reverse by the user, the user immediately becomes aware of the wrong process cartridge orientation.

Further, since the size of one of the openings provided in the apparatus main assembly is made smaller than the size of one of the guide projections provided on the process cartridge, the user cannot incorrectly insert the process cartridge into the apparatus main assembly even if the user tries. Therefore, the incorrect insertion of the process cartridge does not occur.

Embodiment 1

Figure 4:
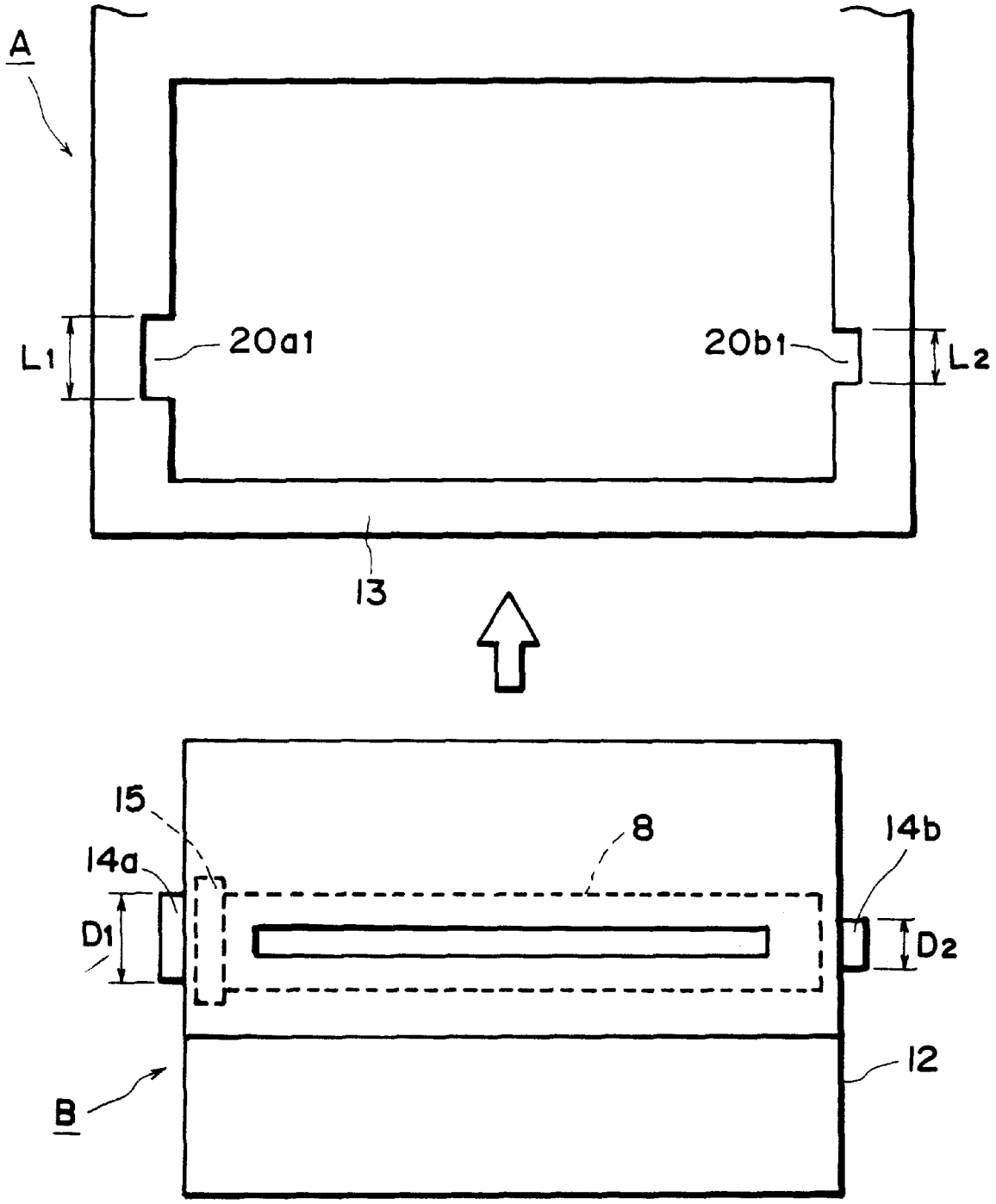
FIG. 4 gives the size of the guide projection of a process cartridge, and the size of the opening of the image forming apparatus main assembly.
Figure 5:
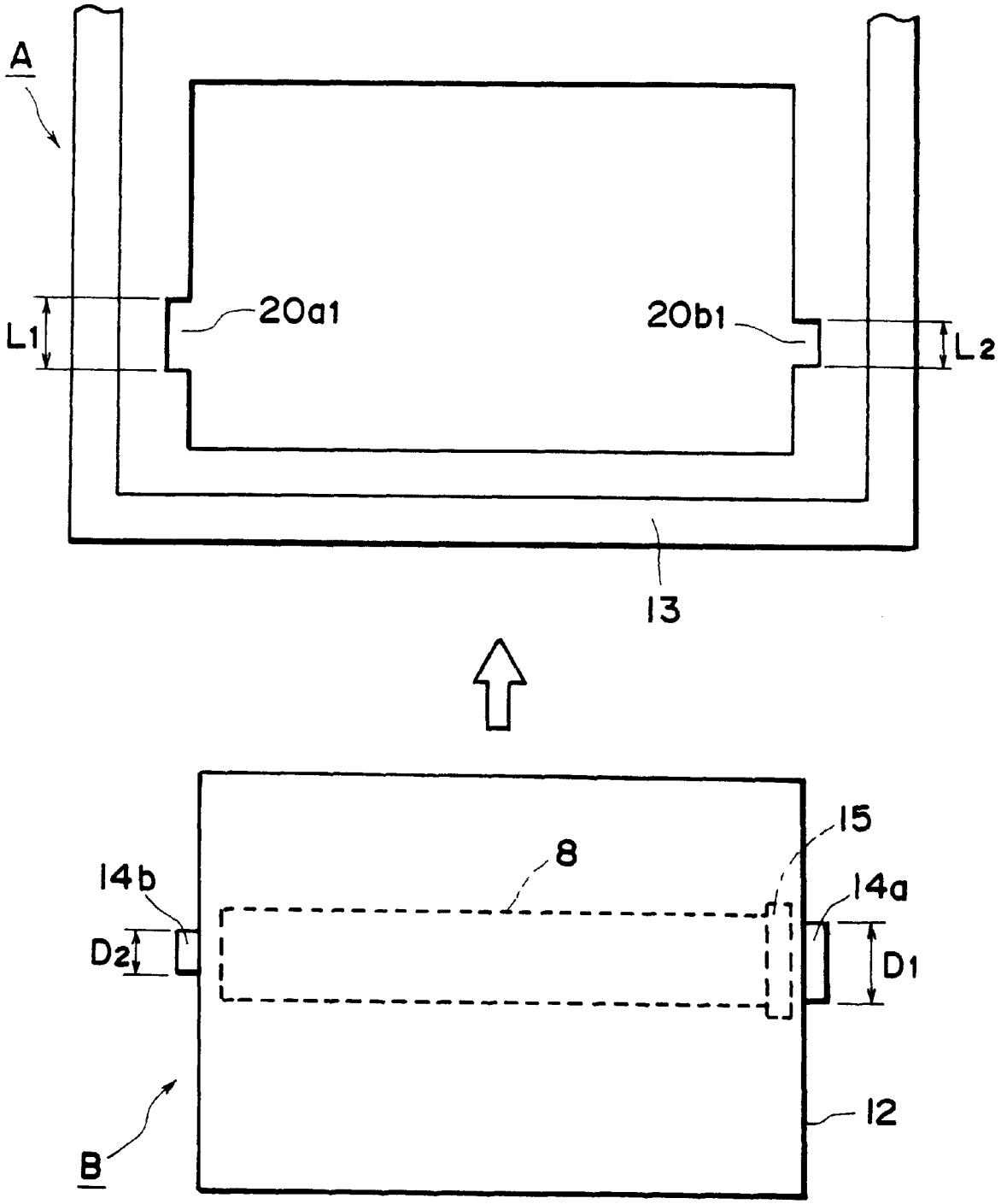
FIG. 5 depicts a situation in which a process cartridge is being reversely inserted.
Figure 6:
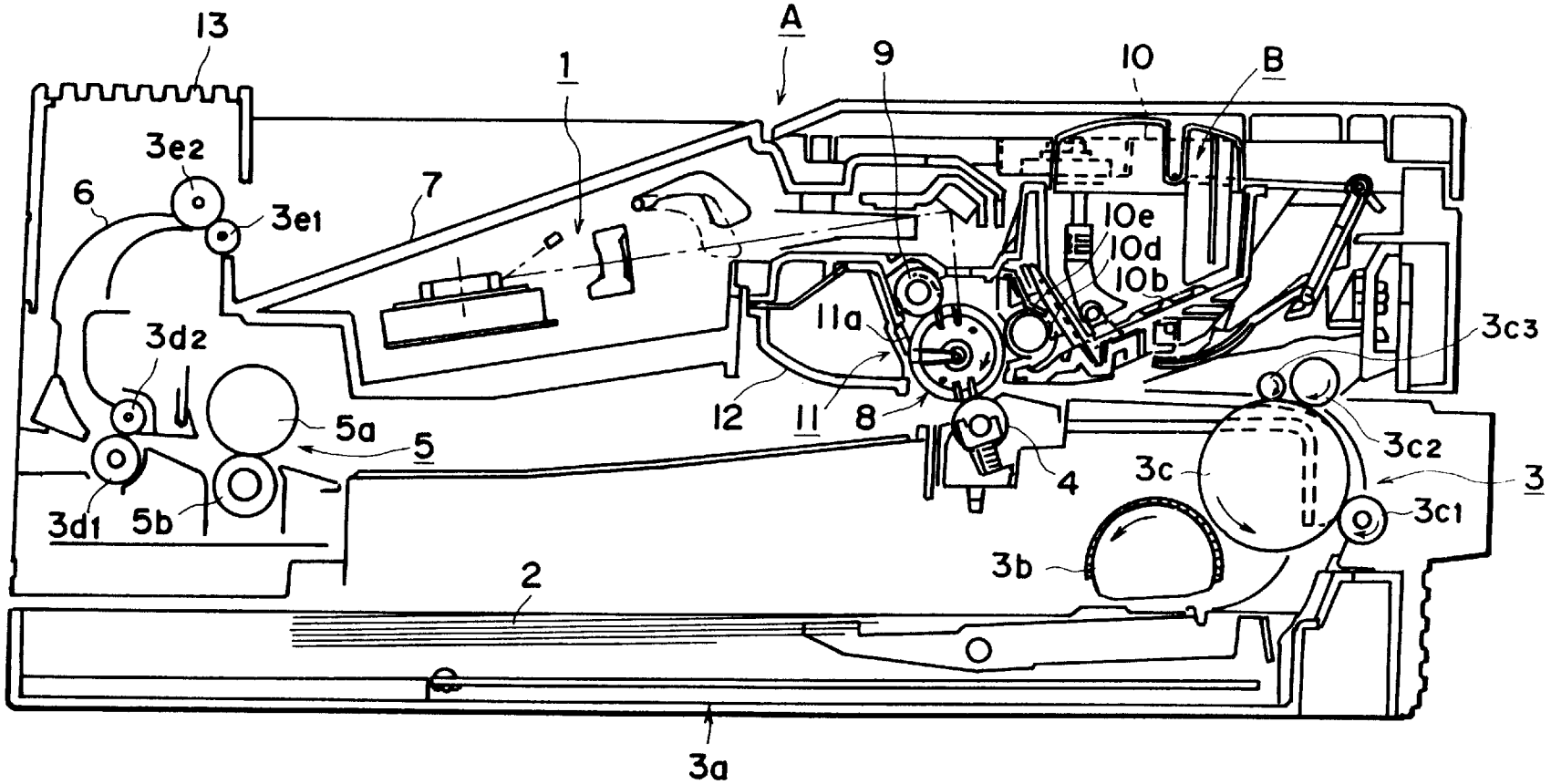
FIG. 6 is a sectional view of the general structure of an image forming apparatus containing a process cartridge.
Figure 7:
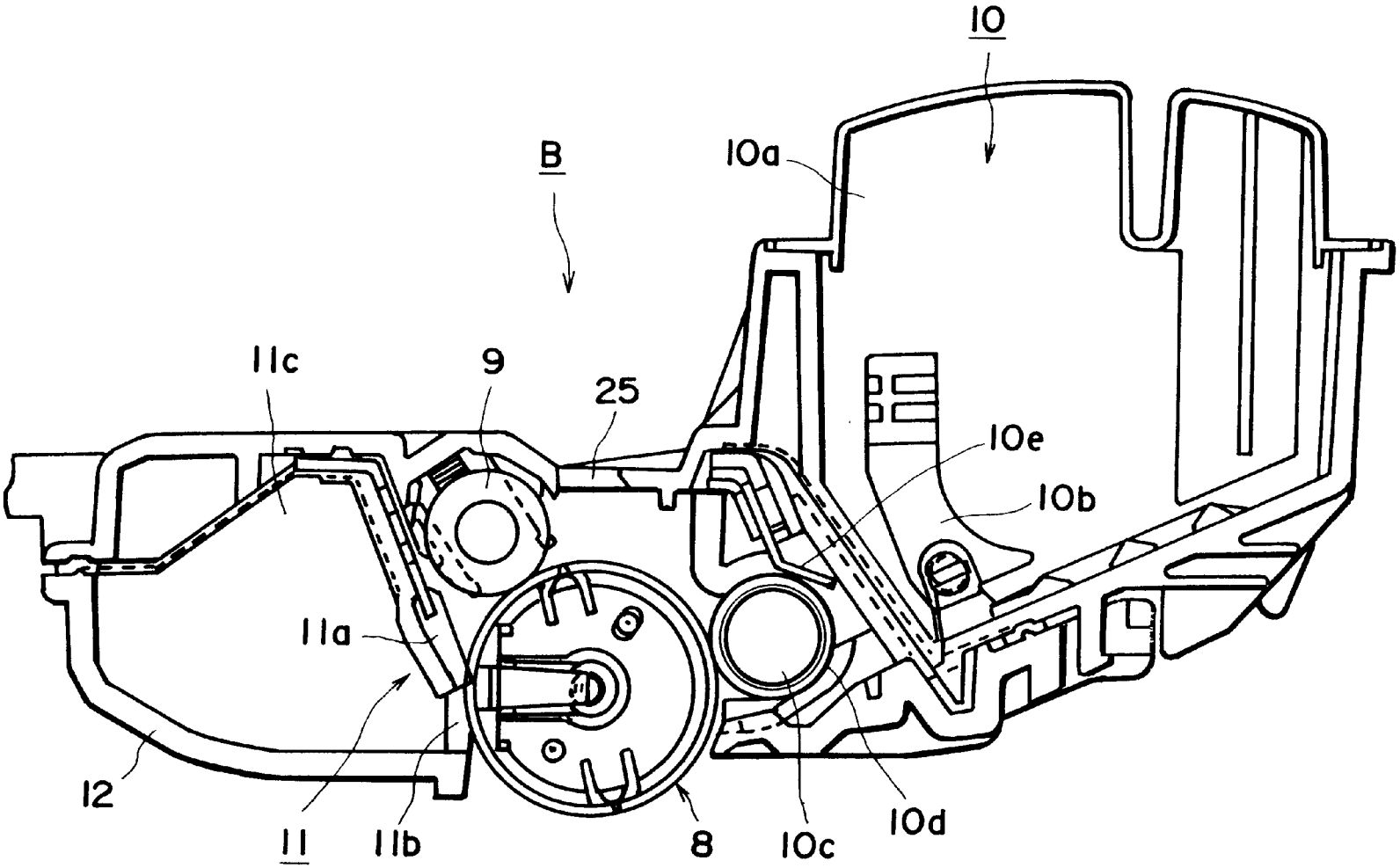
FIG. 7 is a sectional view of a process cartridge.

Referring to FIGS. 1–7, embodiments of process cartridges and image forming apparatuses in accordance with the present invention will be described in detail. FIGS. 1–5 depict the structures, which are involved with insertion of the process cartridge; FIG. 6 is a sectional view of the overall structure of an image forming apparatus; and FIG. 7 is a sectional view of a process cartridge.

To begin with, referring to FIGS. 6 and 7, the overall structures of the process cartridge, and the image forming apparatus in which the process cartridge can be installed, will be described. Then, referring to FIGS. 1–5, the structures involved with the process cartridge insertion will be described.

(Overall Structure)

Referring to FIG. 6, in this electro-photographic image forming apparatus, an optical image based on image data is projected from an optical system 1 onto an electro-photographic photosensitive member charged in advance by charging means, forming thereby a latent image on the electro-photographic photosensitive member. Then, this latent image is developed into a toner image by developing means. Meanwhile, in synchronism with the formation of the toner image, a recording medium 2 is fed out of a cassette 3*a* by a pickup roller 3*b*, and is conveyed by a conveying means 3 consisting of a reversing roller 3*c*, pinch rollers 3*c*1, 3*c*2, 3*c*3 and the like, which are pressed upon the reversing roller 3*c*. Next, the toner image formed on the electro-photographic photosensitive member is transferred onto the recording medium 2 by applying a voltage to a transfer roller 4 as transferring means. After the toner image is transferred onto the recording medium 2, the recording medium 2 is delivered to a fixing means 5 comprising a fixative rotary member 5*a* containing a heater, and a driving roller 5*b*, which conveys the recording medium 2 while pressing it into the rotary member 5*a*. The fixing means 5 fixes the transferred image to the recording medium 2. Then, the recording medium, to which the toner image has been fixed, is further conveyed by a pair of conveyer rollers 3*d*1 and 3*d*2, through a reversing path 6, and is discharged into a discharge portion 7.

On the other hand, referring to FIG. 7, in a process cartridge B, a photosensitive drum 8, as the electro-photographic photosensitive member, provided with a photosensitive layer is rotated, and as it is rotated, the surface thereof is uniformly charged by applying a voltage to a charge roller 9 as charging means. Then, the uniformly charged surface of the photosensitive drum 8 is exposed to the optical image, which is projected from the aforementioned optical system 1 through an exposure opening 25, forming thereby a latent image. This latent image is developed by a developing means 10.

In the developing means 10, the toner within a toner reservoir is fed out by a toner feeding member 10*b*, and is formed into a triboelectrically charged toner layer on the surface of a development roller 10*d*, by a development blade 10*e*, as the development roller 10*d* containing a fixed magnet 10*c*. Then, the toner in the toner layer is transferred onto the photosensitive drum 8, corresponding to the aforementioned latent image, whereby the latent image is visualized as a toner image. The toner image is transferred onto the recording medium 2 by applying to the transfer roller 4, a voltage with polarity reverse to the toner image. After the toner image is transferred, the photosensitive drum 8 is cleaned of the residual toner by a cleaning means 11 comprising a cleaning blade 11*a* and a receptor sheet 11*b*; the residual toner is scraped down by the cleaning blade 11*a*, and is scooped up by the receptor sheet 11*b* to be collected in a waste toner storage 11*c*.

The various components mentioned in the foregoing are integrally supported in the cartridge frame 12 to form a cartridge, which can be removably mounted in the apparatus main assembly 13 by the cartridge accommodating means provided in the apparatus main assembly 13. The cartridge frame 12 is formed by joining a top frame portion and a bottom frame portion.

(Structure of Cartridge Accommodating Means)

Next, the structure for mounting the process cartridge B into the apparatus main assembly will be described.

Figure 1:
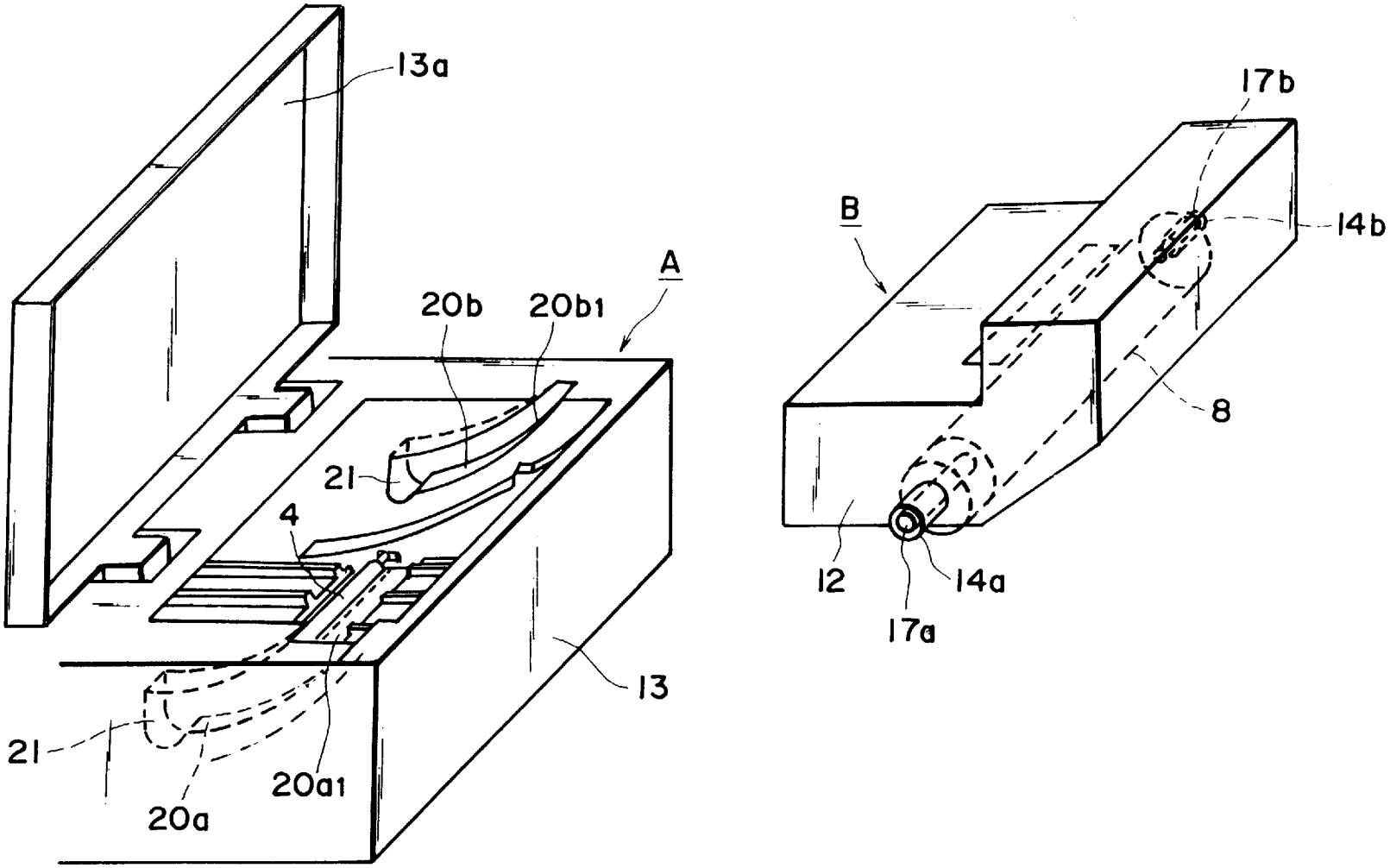
FIG. 1 is a perspective view depicting the structure for inserting a process cartridge into the main assembly of an image forming apparatus.
Figure 2:
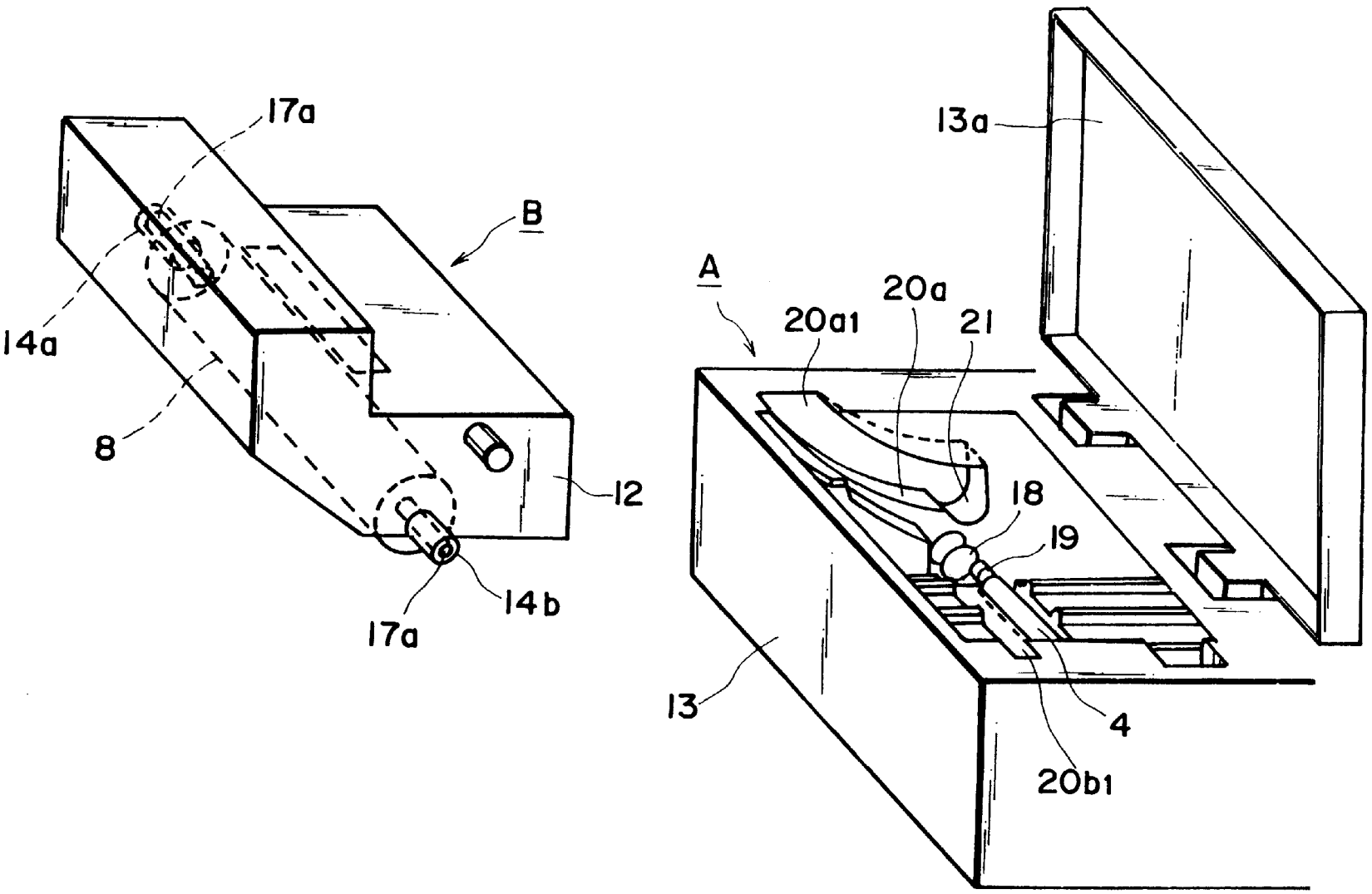
FIG. 2 is a perspective view depicting the structure for inserting a process cartridge into the main assembly of an image forming apparatus.

Referring to FIGS. 1 and 2, the process cartridge B is provided with a first guide projection 14*a* and a second guide projection 14*b*, which are in alignment with the rotational axis of the photosensitive drum 8, and project outwardly from the corresponding lateral surfaces of the process cartridge B relative to its longitudinal direction. In other words, the guide projections 14*a* and 14*b* are on the imaginary extension of the rotational axis of the photosensitive drum 8.

Figure 3:
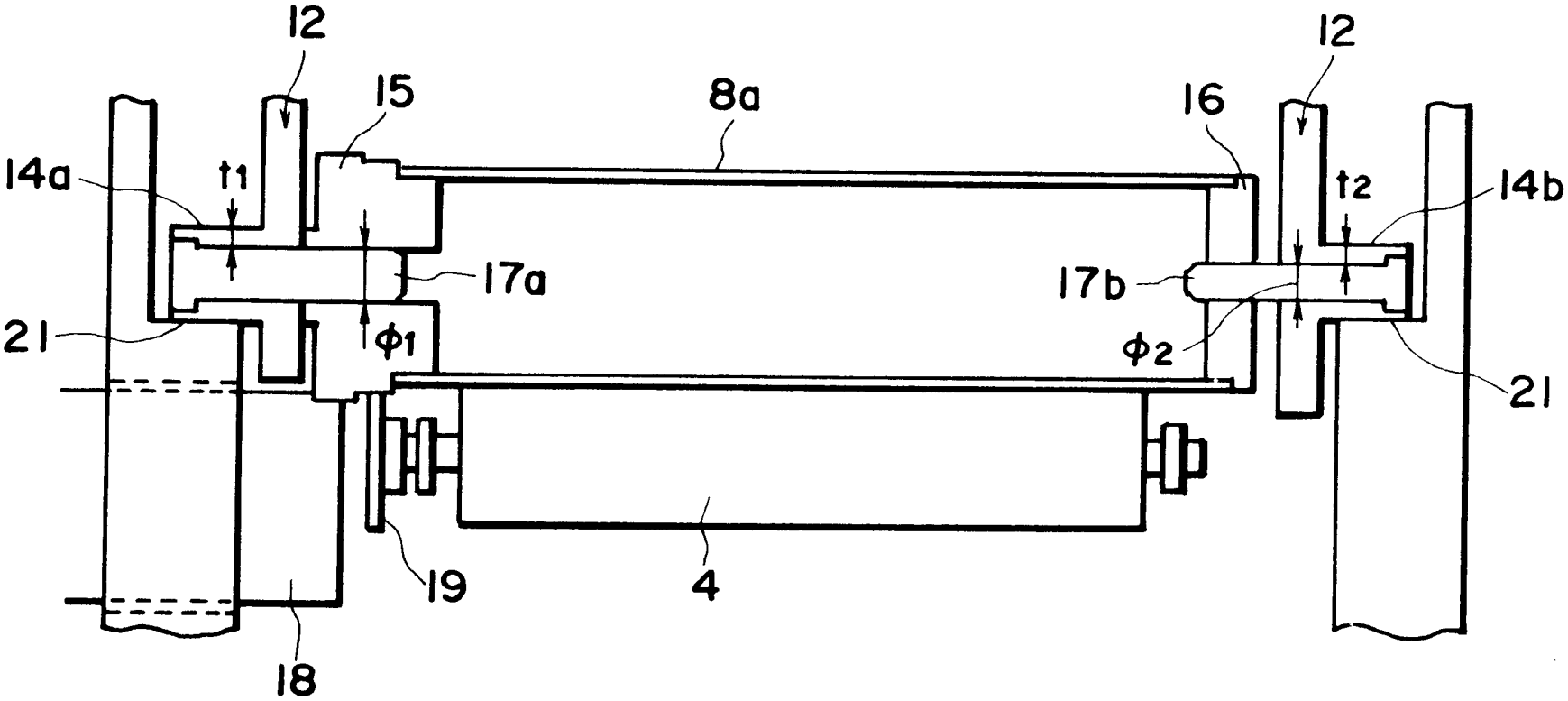
FIG. 3 is a sectional view of the structure which supports the axles of a photosensitive drum.

Referring to FIG. 3, a drum gear 15 is fixed to one end of the cylindrical drum base 8*a* of the photosensitive drum 8, and a flange 16 is fixed to the other end. Drum shafts 17*a* and 17*b* are inserted through the corresponding holes provided in the guide projections 14*a* and 14*b*, and are fitted in the holes of the drum gear 15 and flange 16, respectively, to rotatively support the photosensitive drum 8. More specifically, the portions of the cartridge frame 12, in which the drum shafts 17*a* and 17*b* are fixed by being pressed thereinto, are formed into external projections with a predetermined precise length, so that the drum shafts 17*a* and 17*b* can be pressed in by the precise length. These external projections with the predetermined length constitute the guide projections 14*a* and 14*b*.

As the process cartridge B is mounted in the apparatus main assembly 13, the drum gear 15 receives a driving force by engaging with a driving force transmission gear 18 provided on the apparatus main assembly side, and rotates the photosensitive member 8. Further, the drum gear 15 is a compound gear, which also engages with a transfer gear 19 mounted at one end of the transfer roller 4, to transmit the driving force to the transfer roller 4.

The drum shaft 17*a*, which supports the drum gear 15 as described above, is subjected to a larger load than the drum shaft 17*b*, which supports the flange 16, due to the force generated as the meshed gears rotate. Therefore, the drum shaft 17*a* must be more rigidly supported than the drum shaft 17*b*. In this embodiment, the rigidity is provided by increasing the thickness (diameter) $\phi_1$ of the drum shaft 17*a* on the drum gear side, compared to the $\phi_2$ of the drum shaft 17*b* on the flange gear side ($\phi_1>\phi_2$), and also, by rendering greater the thickness $t_1$ of the cartridge frame portion, into which the drum shaft 17*a* is pressed, relative to the thickness $t_2$ of the cartridge frame portion, into which the drum shaft 17*b* is pressed ($t_1>t_2$).

Therefore, even though the guide projections 14*a* and 14*b* are the same in terms of configuration, that is, both are cylindrical, the guide projection 14*a* is larger in diameter than the guide portion 14*b*.

Referring to FIGS. 1 and 2, the main assembly 13 of the image forming apparatus, on the other hand, is provided with a cartridge accommodating space, which is exposed as a lid 13*a* is opened. In the left and right internal walls of this cartridge accommodating space, a first guide portion 20*a* and a second guide portion 20*b* for guiding the cartridge are formed, respectively. They oppose each other across the space.

The guide portions 20*a* and 20*b* are in the form of a groove extending diagonally downward in the direction of cartridge insertion. At the bottom end of each guide portion, a U-shaped recess 21 is formed to fix the position of the process cartridge B.

At the top end of the first guide portion 20*a*, a first opening 20*a*1, through which the first guide projection 14*a* of the process cartridge B is inserted, is provided, and at the top end of the second guide portion 20*b*, a second opening 20*b*1, through which the second guide projection 14*b* is inserted, is provided. Referring to FIG. 4, the width L1 of the first opening 20*a*1 is slightly greater than the external diameter D1 of the first guide projection 14*a*, and the width L2 of the second opening 20*b*1 is slightly greater than the external diameter D2 of the second guide projection 14*b* (D1>D2). Further, the width L2 of the second opening 20*b*1 is less than the external diameter D1 of the first guide projection 14*a* (L2<D1).

Therefore, when the process cartridge B is mounted in the apparatus main assembly, after the lid 13*a* is opened, the first and second guide projections 14*a* and 14*b* are inserted through the first and second openings 20*a*1 and 20*b*1; are made to follow the guide portions 20*a* and 20*b*; and are dropped into the corresponding recesses 21. Then, the lid 13*a* is closed, ending the insertion.

As the process cartridge B is inserted into the apparatus main assembly as described above, its position in the apparatus main assembly is fixed, readying the image forming apparatus for image formation, with the drum gear 15 being meshed with the driving force transmission gear 18. Since the first guide projection 14*a* provided on the drum gear side is formed thicker than its counterpart, it can stably support the process cartridge B in the apparatus main assembly, in spite of a large load, to which the first guide portion 14*a* is subjected as the driving force is transmitted.

Referring to FIG. 5, when the process cartridge B is inserted into the apparatus main assembly, if it is placed in reverse in terms of right or left, the first guide projection 14*a* cannot be put through the second opening 20*b*1 (L2<D1). Therefore, the users notice that the process cartridge B is incorrectly oriented. Consequently, partial insertion of the incorrectly oriented process cartridge B into the apparatus main assembly does not occur. In other words, according to this embodiment of the present invention, the users notice that the process cartridge B is improperly oriented in terms of right or left, at the initial stage of cartridge insertion. Therefore, the process cartridge B can be more efficiently inserted.

Embodiment 2

Next, another structure for inserting the process cartridge B will be presented as the second embodiment of the present invention. Since the basic structures of the process cartridge B and image forming apparatus A in the second embodiment are the same as those in the first embodiment, only the portions different from the first embodiment will be described. Further, the same members in the first and second embodiments are designated by the same symbols.

In the first embodiment, the drum gear 15, which transmits the driving force, consists of a compound gear, and the driving force is transmitted through only one longitudinal end of the process cartridge B, that is, through this gear 15 meshed with the transfer gear 19. However, the flange 16, which is fixed to the other longitudinal end of the process cartridge in the first embodiment, may be replaced by a gear, which may be meshed with the transfer gear 19.

When the structure described in the foregoing is employed, the driving force is delivered to the photosensitive drum 8 through the drum gear 15 mounted on one end of the photosensitive drum 8, and is transmitted to the transfer roller 4 through the gear mounted on the other end of the photosensitive member 8.

In this case, the gear for rotating the transfer roller 4 is toothed to rotate the transfer roller 4 faster than the photosensitive drum 8, but the load resulting from such a gear ratio is relatively small in relation to the overall rotational load of the photosensitive drum 8, allowing the rigidity of the gear, which rotates the transfer roller 4, to be less than the rigidity of the drum gear, through which the driving force is transmitted to the photosensitive drum 8 from the apparatus main assembly 13. Therefore, it is also possible, in this case, to make the first guide projection 14*a* larger on the side of the drum gear 15 than the second guide projection 14*b* on the transfer gear side. This structure can offer the same effects as the structure in the first embodiment.

Embodiment 3

Next, another structure for inserting the process cartridge B will be described as the third embodiment of the present invention. Since the basic structures of the process cartridge B and image forming apparatus A in the third embodiment are quite the same as those in the first embodiment, only the portions different from the first embodiment will be described. Further, the same members in this embodiment and the first embodiment are designated by the same symbols.

In the first embodiment, the guide projections 14*a* and 14*b* are cylindrical, but it is unnecessary to limit the configuration of the guide projections 14*a* and 14*b* to a cylindrical one. They may be partially cylindrical, or may be in the form of a multi-faceted pillar.

Figure 8A:
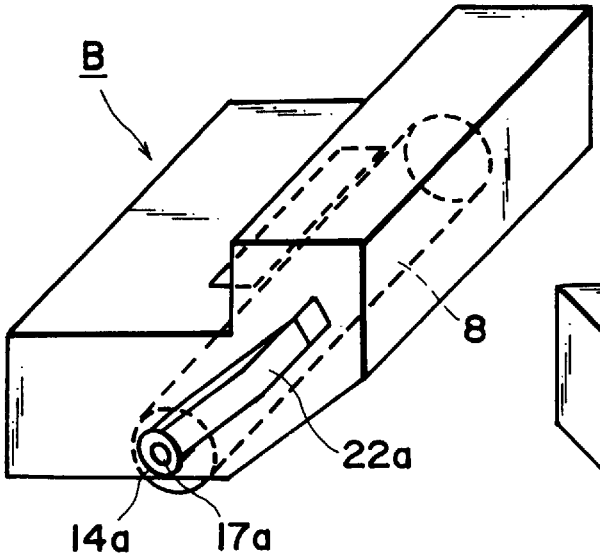
FIGS. 8(*a*) and 8(*b*) are perspective views of a process cartridge provided with regulating portions, each of which extends from the corresponding guide projection.
Figure 8B:
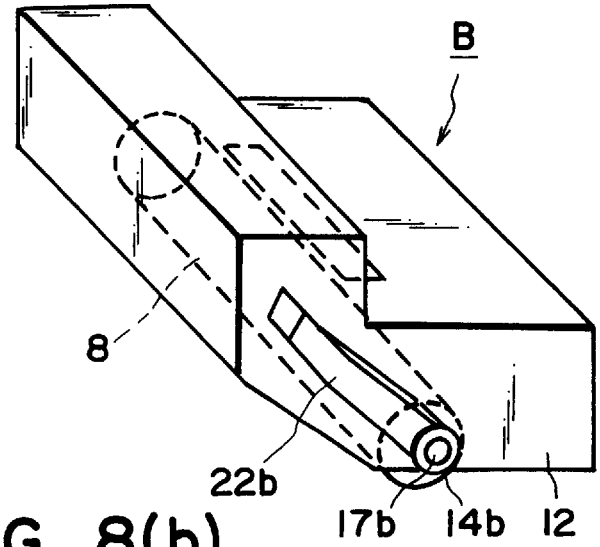
Figure 9:
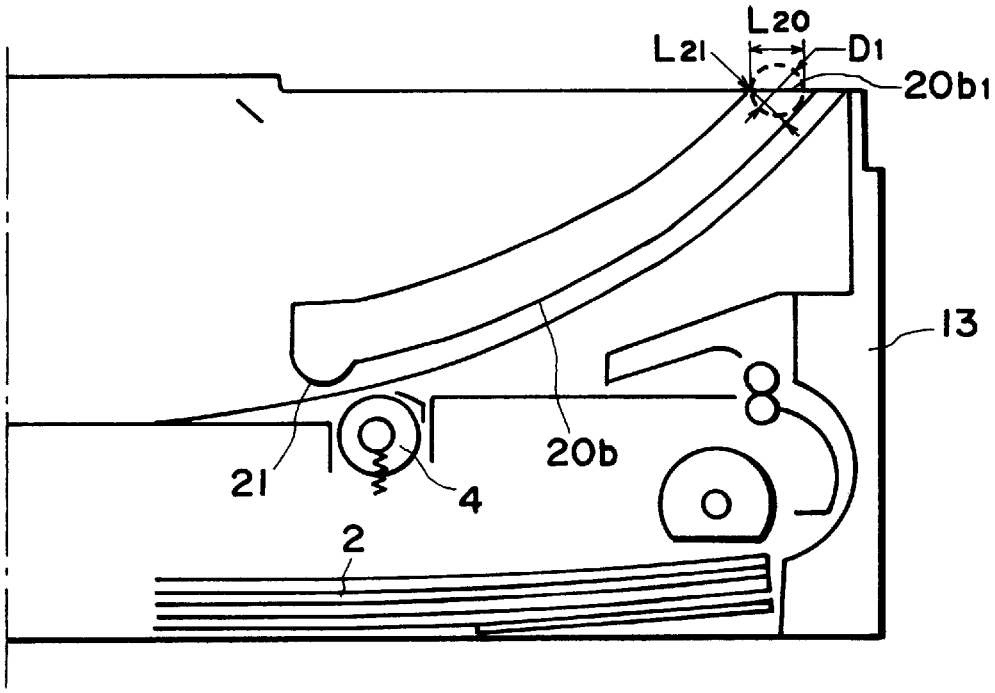
FIG. 9 depicts an embodiment of the present invention, in which the width of the second opening notch is greater than the external diameter of the first guide projection.

It is also unnecessary to limit the guide projection choice to be in alignment with the rotational axis of the photosensitive drum 8. Instead, regulator arms 22*a* and 22*b*, the thicknesses of which are less than the diameters of the guide projections 14*a* and 14*b*, respectively, may be extended from the guide projections 14*a* and 14*b* in the direction opposite to the cartridge insertion direction as shown in FIGS. 8(*a*) and 8(*b*).

This arrangement not only prevents the incorrect insertion of the process cartridge B as the structure of the first embodiment does, but also makes it easier to insert the process cartridge B, since, when the process cartridge B is normally inserted, the regulator arms 22*a* and 22*b* come into contact with the guide portions 20*a* and 20*b*, respectively, controlling thereby the orientation of the process cartridge B.

Embodiment 4

Next, another structure for inserting the process cartridge B will be described as the fourth embodiment of the present invention. Since the basic structures of the process cartridge B and image forming apparatus A in the fourth embodiment are quite the same as those in the first embodiment, only the portions different from the first embodiment will be described. Further, the same members in this embodiment and the first embodiment are designated by the same symbols.

In the first embodiment, the width L2 of the second opening 20*b*1 is made less than the external diameter D1 of the first guide projection 14*a* (L2<D1), so that the first guide projection 14*a* cannot be put through the second opening 20*b*1. However, the width L20 of the second opening 20*b*1 may be larger than the external diameter D1 of the first guide projection 14*a* (L20>D1) as long as the width L21 of the guide portion 20*b*, which actually regulates the insertion of the first guide projection 14*a*, is less than the external diameter D1 of the first guide projection 14*a* (L21<D1).

In this case, even if the process cartridge B is oriented in reverse in terms of right or left, the first guide projection 14*a* can be partially put through the second opening 20*b*1, but is not allowed to advance through the guide portion 20*b* beyond the entrance. Therefore, the user becomes aware of the incorrect insertion. In other words, as long as the relationship between the external diameter of the first guide projection 14*a* and the width of the second opening 20*b*1 is such that the first guide projection 14*a* cannot be put through the second opening 20*b*1 in practical terms, the incorrect insertion of the process cartridge B can be prevented.

Embodiment 5

Next, another structure for inserting the process cartridge B will be described as the fifth embodiment of the present invention. Since the basic structures of the process cartridge B and image forming apparatus A in the fifth embodiment are quite the same as those in the first embodiment, only the portions different from the first embodiment will be described. Further, the same members in this embodiment and the first embodiment are designated by the same symbols.

Figure 10:
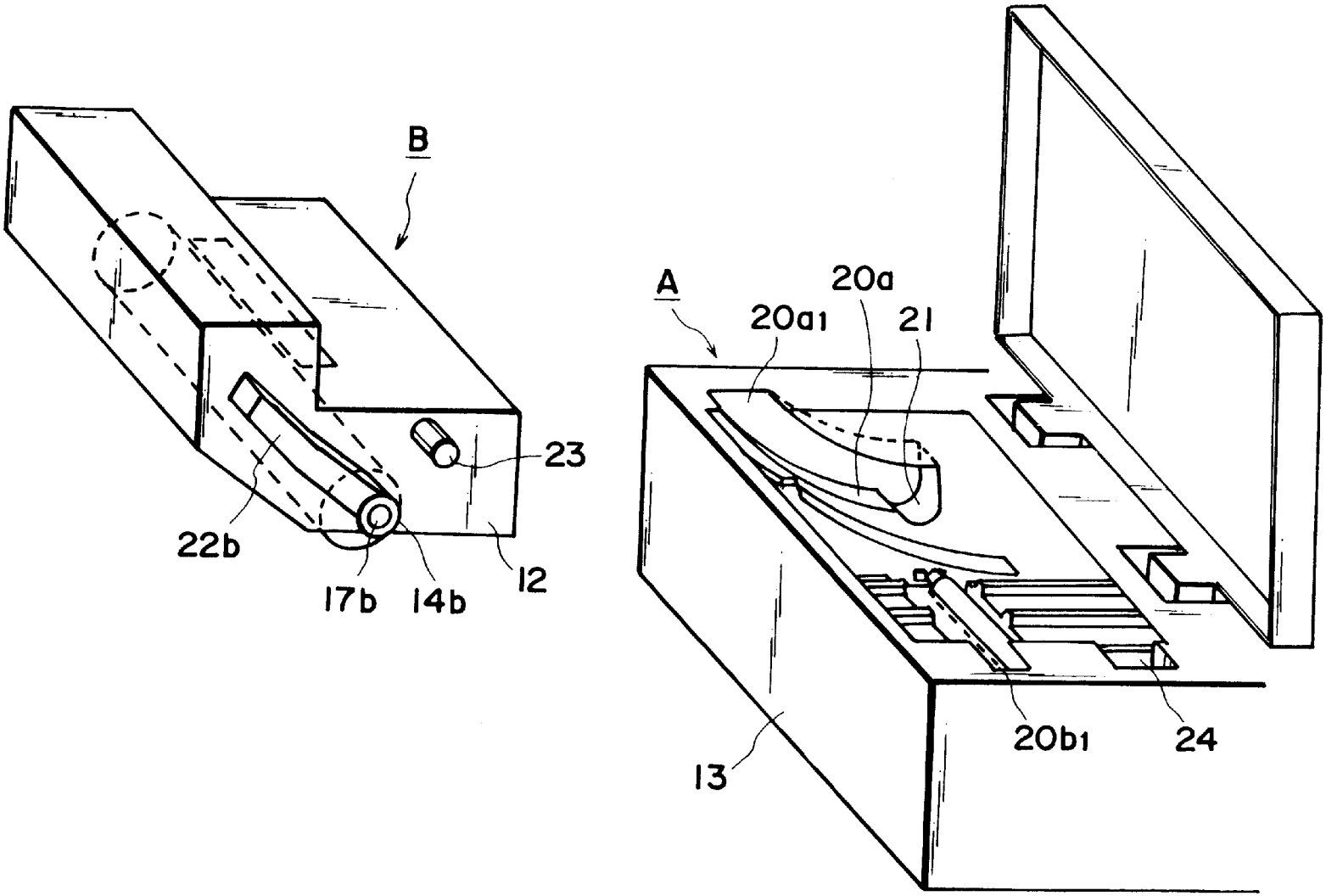
FIG. 10 depicts a process cartridge, the second guide projection side of which is provided with a third guide projection, and the portion of an image forming apparatus, which accommodates such a process cartridge.
Figure 11:
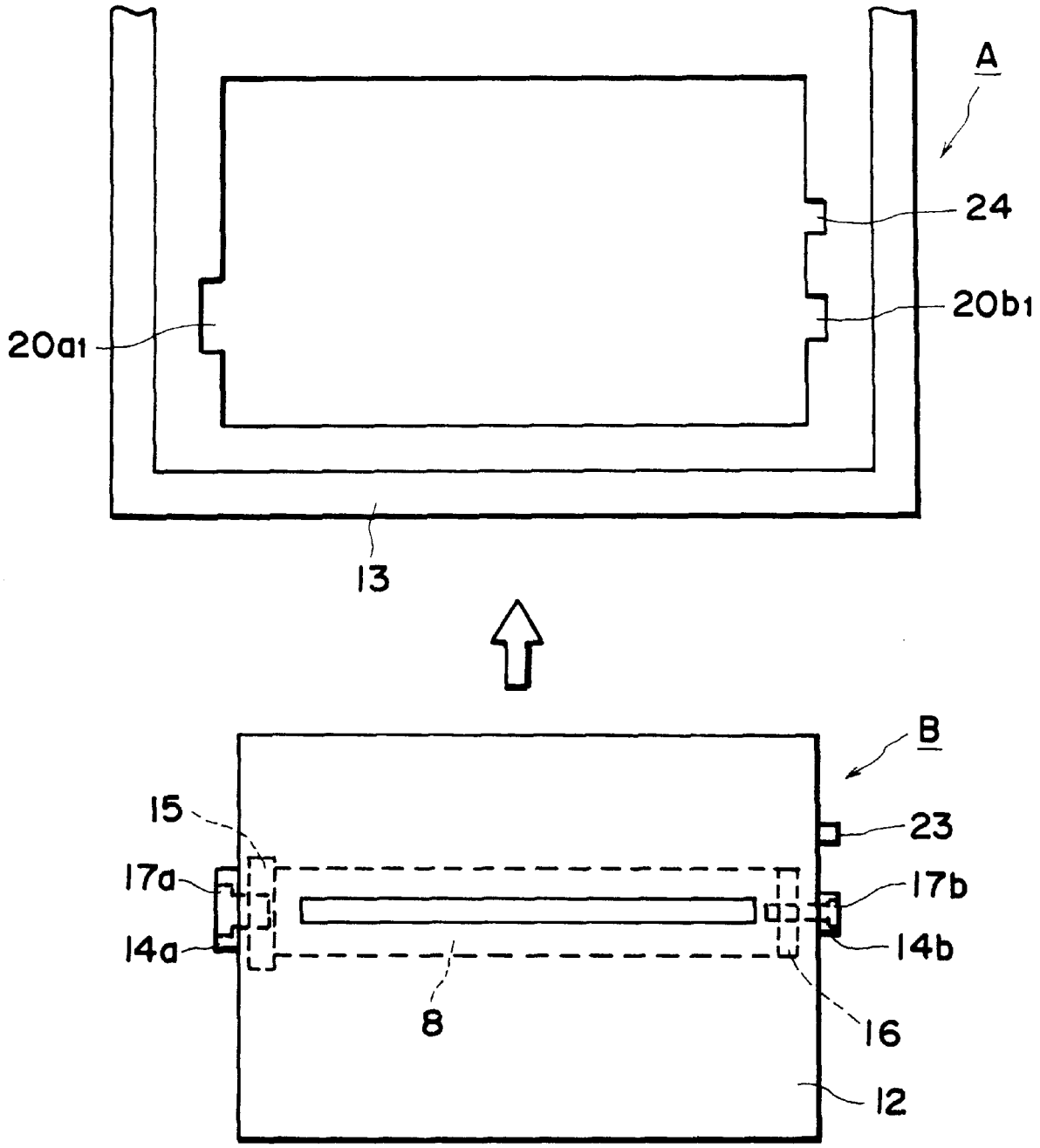
FIG. 11 depicts a situation in which a process cartridge provided with the third guide projection is being normally inserted.
Figure 12:
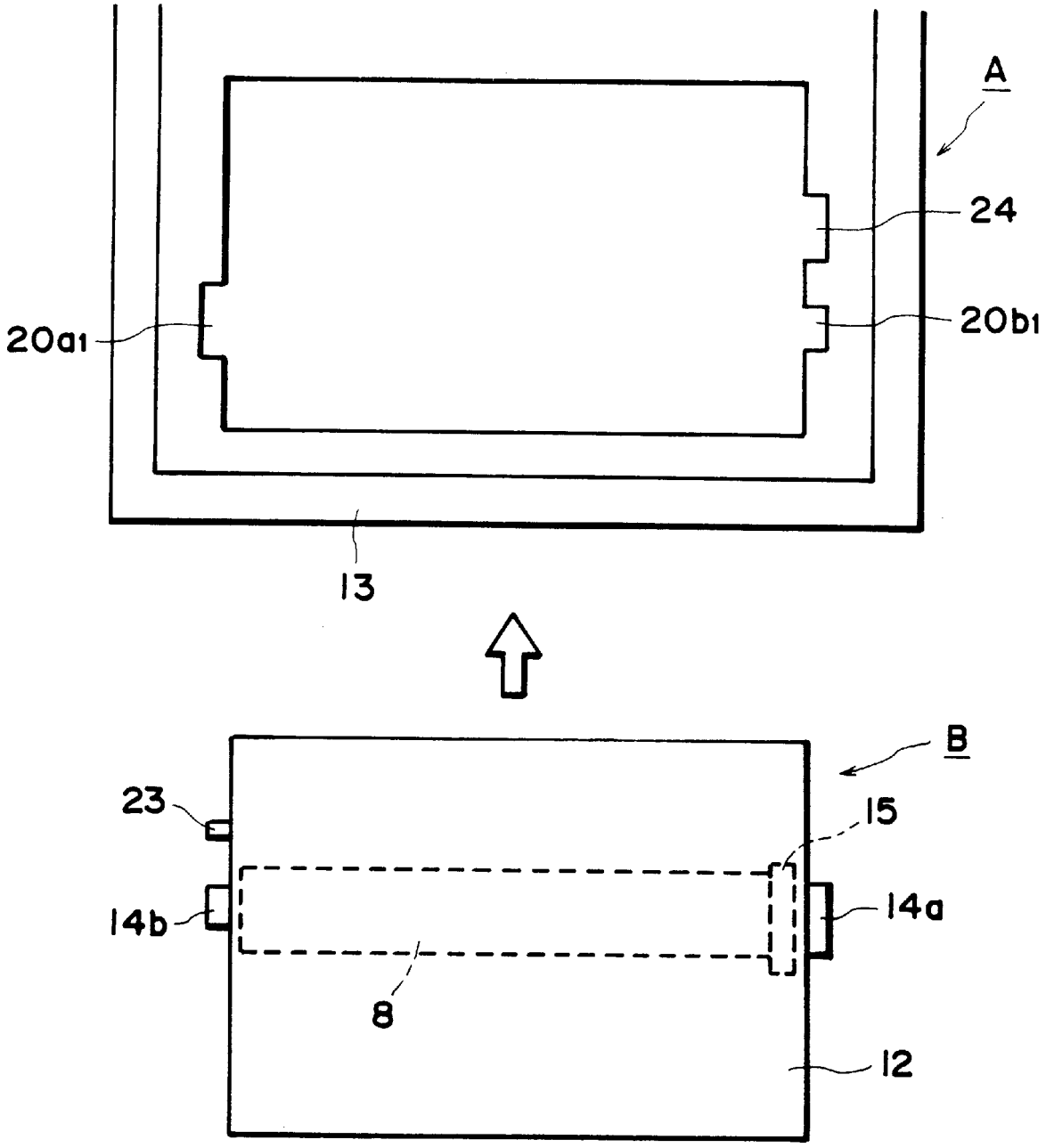
FIG. 12 depicts a situation, in which a process cartridge provided with the third projection is being incorrectly inserted.
Figure 13A:
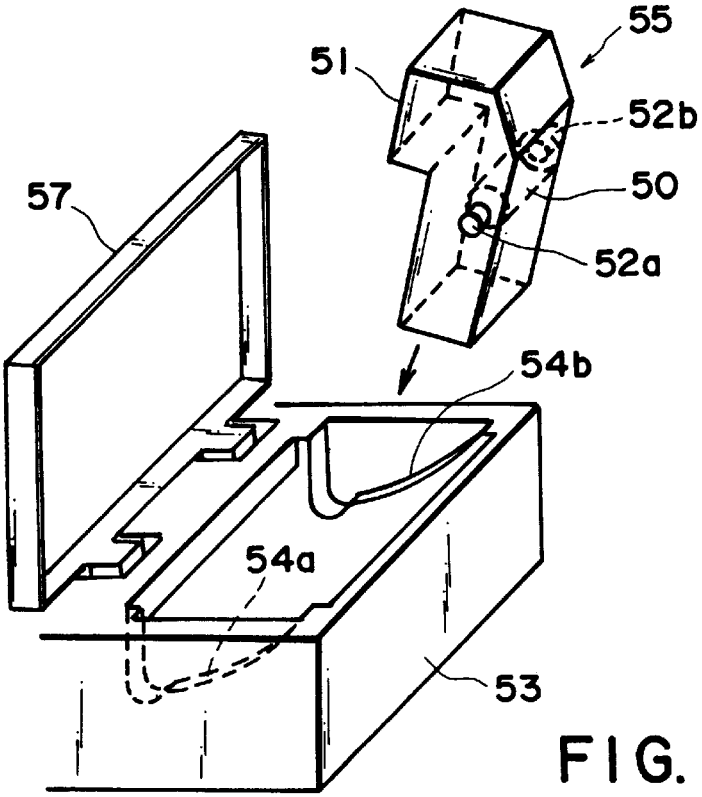
FIG. 13(a) PRIOR ART
FIG. 13(*a*) depicts a situation, in which a conventional process cartridge is being correctly inserted, and FIG. 13(*b*) depicts another situation, in which a conventional process cartridge is being incorrectly inserted.
Figure 13B:
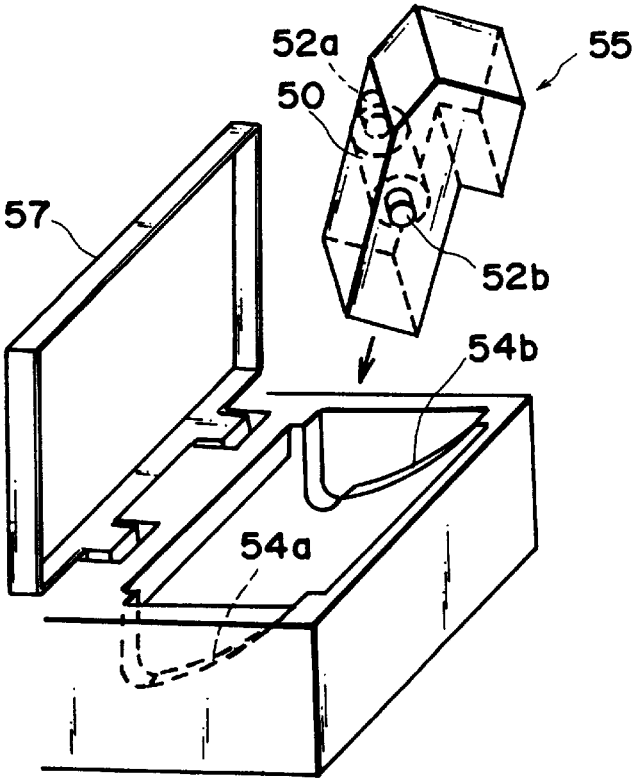
FIG. 13(b) PRIOR ART

In the first embodiment, the structure is such that when an attempt is made to insert a process cartridge oriented in reverse in terms of right or left into the apparatus main assembly 13, only the side of the first guide projection 14*a* is prevented from entering the apparatus main assembly 13, but both sides of the process cartridge B may be prevented from entering the apparatus main assembly 13 by providing the process cartridge B and apparatus main assembly 13 with the structures shown in FIGS. 10–12.

That is, a third guide projection 23 is provided on the side where the second guide projection 14*b* is, and a third opening is provided in the apparatus main assembly 13, as shown in FIG. 10.

When this process cartridge B is correctly inserted into this apparatus main assembly 13, the guide portions 14*a*, 14*b* and 23 enter the openings 20*a*1, 20*b*1 and 24, respectively, as shown in FIG. 11, allowing the process cartridge to be completely inserted, but when an inadvertent attempt is made to insert a process cartridge, which is incorrectly oriented in terms of right or left, the first guide projection 14*a* on one side of the cartridge B is not allowed to pass through the second opening 20*b*1, and the third guide projection 23 on the other side of the cartridge B is not allowed to pass through the first opening 20*a*1; and the location of the third guide projection 23 does not match the location of the first opening 20*a*1.

Therefore, the incorrectly oriented process cartridge B is prevented, on both sides, from being inserted into the apparatus main assembly 13, reliably informing the users of the incorrect insertion.

Other Embodiments

Hereinafter, means, and component structures, which are different from those employed in the preceding embodiment, will be described.

The present invention is preferably applicable not only to a monochromatic process cartridge such as the process cartridge B described in each of the preceding embodiments, but also to a multicolor process cartridge, in which plural developing means are provided to from multicolor images, for example, two-tone color images, three-color images, full-color images, or the like.

Further, the present invention is applicable to a variety of known development methods such as the magnetic brush development method using two component developer, the cascade development method, the touch-down development method, the cloud development method, and the like.

The electro-photographic photosensitive member, which is usable with the present invention, is not limited to the photosensitive drum described in the preceding embodiments. It may include the following. As for the photosensitive material, photoconductive material is employed; for example, amorphous silicon, amorphous selenium, zinc oxide, titanium oxide, organic photoconductor (OPC), and the like. The configuration of the base, on which the photosensitive material is placed, may be in the form of a drum, a belt, or a sheet. Generally speaking, the base in the form of a drum or an endless belt is used. For example, a drum-type photosensitive member is produced by depositing or coating photoconductive material on a cylinder of aluminum alloy or the like.

As for the structure of charging means, a so-called contact charge method was employed in the first embodiment. However, it is obvious that different structures may be employed. For example, a conventional structure may be employed, in which a tungsten wire is surrounded on three sides with shields of metallic material such as aluminum, and a high voltage is applied to the tungsten wire to generate positive or negative ions, which are transferred to the photosensitive member surface to uniformly charge the photosensitive member surface.

As for the shape of the charging means, it may be in the form of a blade, (charge blade), a pad, a block, a rod, a wire, or the like, in addition to the aforementioned roller.

Further, as for the cleaning method of the toner remaining on the photosensitive drum, the cleaning means may comprise of a blade, a fur brush, a magnetic brush, or the like.

In the preceding embodiments, the process cartridge comprises an electro-photographic photosensitive member, and at least one processing means. However, the present invention is applicable to many other process cartridges besides the one described in the preceding embodiments. For example, an electro-photographic photosensitive member and charging means may be integrated in the form of a cartridge, which can be removably installed in the apparatus main assembly; an electro-photographic photosensitive member and developing means may be integrated in the form of the cartridge; an electro-photographic photosensitive member and cleaning means may be integrated in the form of the cartridge; and also, an electro-photographic photosensitive member and two or more of the aforementioned processing means may be integrated in the form of the cartridge, which can be removably installed in the apparatus main assembly.

In other words, the aforementioned process cartridge is a cartridge, which integrally comprises the charging means, developing means, or cleaning means, and the electro-photographic photosensitive member, and can be removably installed in the main assembly of an image forming apparatus; a cartridge, which integrally comprises the electro-photographic photosensitive member, and at least one of the charging means, developing means, and cleaning means, and can be removably installed in the main assembly of an image forming apparatus; or a cartridge, which integrally comprises the electro-photographic photosensitive member, and at least the developing means, and can be removably installed in the main assembly of an image forming apparatus.

In the preceding embodiments, the image forming apparatuses were exemplified by a laser beam printer. However, the application of the present invention is not limited to laser beam printers; for example, it is also applicable, to other image forming apparatuses such as electro-photographic copying machines, facsimiles, or word processors.

As described above, according to the present invention, the guide projection formed on one of the lateral walls of the cartridge frame is larger than the counterpart formed on the opposing lateral wall; therefore, when an inadvertent attempt is made by a user to insert the process cartridge in reverse, the user simply becomes aware of the incorrect orientation of the process cartridge.

Further, the driving force transmission member of the process cartridge is disposed on the same side as the larger guide projection; therefore, the supportive rigidity is increased on the side, which is subjected to the load resulting from driving force transmission. As a result, the process cartridge is more stably supported when images are formed, and also, the process cartridge size can be reduced by an optimum design.

Further, in addition to the first and second guide projections provided on the corresponding sides of the process cartridge, the third guide projection is provided; therefore, the process cartridge can be more reliably prevented from being incorrectly inserted.

Further, the size of one of the openings provided in the apparatus main assembly is rendered smaller than one of the guide projections; therefore, an inadvertent attempt by a user to incorrectly insert the process cartridge cannot be successful, preventing thereby the process cartridge from being incorrectly inserted.

As is evident from the above descriptions, according to the present invention, a process cartridge can be correctly installed in an electro-photographic image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electro-photographic image forming apparatus, said process cartridge comprising:

a cartridge frame;

an electro-photographic photosensitive drum;

processing means for acting on said electro-photographic photosensitive drum;

a first projection projecting outwardly from one of opposite ends of said cartridge frame, and coaxially with said electro-photographic photosensitive drum; and a second projection projecting outwardly from the other of said opposite ends of said cartridge frame, and coaxially with said electro-photographic photosensitive drum, wherein said first projection and said second projection are cylindrical, and a diameter of said second projection is larger than a diameter of said first projection.

2. A process cartridge according to claim 1, wherein a thickness of a cylindrical wall of said second projection is greater than a thickness of a cylindrical wall of said first projection.

3. A process cartridge according to claim 1 or 2, wherein one end of a first drum shaft, for supporting said electro-photographic photosensitive drum, is pressed into a central portion of said first projection, and one end of a second drum shaft, for supporting said electro-photographic photosensitive drum, is pressed into a central portion of said second projection, and wherein said second drum shaft is larger in diameter than said first drum shaft.

4. A process cartridge according to claim 1, wherein a drum gear is mounted at one end of said electro-photographic photosensitive drum, and wherein, when said process cartridge is mounted to the main assembly of the electro-photographic image forming apparatus, said drum gear meshes with a driving gear provided in the main assembly to receive a driving force for rotating said electro-photographic photosensitive drum.

5. A process cartridge according to claim 4, wherein said drum gear is a compound gear, a first gear portion of which meshes with the driving gear when said process cartridge is mounted to the main assembly of the electro-photographic image forming apparatus, and a second gear portion of which meshes with a transfer roller gear provided in the main assembly of the electro-photographic image forming apparatus to transmit a driving force to the transfer roller for rotating the transfer roller.

6. A process cartridge according to claim 1, wherein, when said process cartridge is mounted to the electro-photographic image forming apparatus, said first projection and said second projection are engaged with recesses provided in the main assembly to position said process cartridge, wherein the main assembly is provided with a first guide portion for guiding said first projection to the recess, and a second guide portion for guiding said second projection to the recess, and wherein an opening of the second guide portion, through which said second projection is to be put, is larger than an opening of the first guide portion, through which said first projection is to be put, thereby preventing said second projection from being put through the opening of the first guide portion.

7. A process cartridge according to claim 1, wherein said process cartridge integrally comprises said electro-photographic photosensitive drum, charging means or developing and cleaning means, as said processing means, and is detachably mountable to the main assembly of the electro-photographic image forming apparatus.

8. A process cartridge according to claim 1, wherein said process cartridge integrally comprises said electro-photographic photosensitive drum, and at least one of charging means, developing means, and cleaning means, as said processing means, and is detachably mountable to the main assembly of the electro-photographic image forming apparatus.

9. A process cartridge according to claim 1, wherein said process cartridge integrally comprises said electrophotographic photosensitive drum and charging means as said processing means, and is removably mountable in the main assembly of the electro-photographic image forming apparatus.

10. An electro-photographic image forming apparatus, for forming an image on a recording material, usable with a detachably mountable process cartridge, said apparatus comprising:

a. mounting means for detachably mounting a process cartridge that includes:

a cartridge frame;

an electro-photographic photosensitive drum;

processing means for acting on said electro-photographic photosensitive drum;

a first projection projecting outwardly from one of opposite ends of said cartridge frame, and coaxially with said electro-photographic photosensitive drum; and a second projection projecting outwardly from the other of the opposite ends of said cartridge frame, and coaxial with said electro-photographic photosensitive drum, wherein said first and second projections are cylindrical, and a diameter of said second projection is larger than a diameter of said first projection;

b. fixing means for fixing on a recording material a toner image, which is formed on said electro-photographic photosensitive drum contained in said process cartridge mounted in said mounting means, and which is transferred onto the recording material; and c. conveying means for conveying the recording material;

wherein said mounting means comprises a first guide portion for guiding said first projection, and a second guide portion for guiding said second projection, and wherein a second projection insertion opening of said second guide portion is larger than a first projection insertion opening of said first guide portion.

11. An electro-photographic image forming apparatus according to claim 10, wherein said electro-photographic image forming apparatus is an electro-photographic copying machine, a laser beam printer, or a facsimile apparatus.

12. A process cartridge detachably mountable to a main assembly of an electro-photographic image forming apparatus, said process cartridge comprising:

a cartridge frame;

an electro-photographic photosensitive drum;

processing means for acting on said electro-photographic photosensitive drum;

a first cylindrical projection projecting outwardly from one of opposite ends of said cartridge frame, and coaxially with said electro-photographic photosensitive drum;

a second cylindrical projection projecting outwardly from the other of the opposite ends of said cartridge frame, and coaxially with said electro-photographic photosensitive drum, said first cylindrical projection having a diameter that is smaller than a diameter of said second cylindrical projection;

a drum gear, which is provided at one axial end of said electro-photographic photosensitive drum, and meshes with a driving gear provided in the main assembly to receive a driving force for rotating said electro-photographic photosensitive drum when said process cartridge is mounted in the main assembly of the electro-photographic image forming apparatus;

a first drum shaft, which is pressed into a central portion of said first cylindrical projection, and which supports said electro-photographic photosensitive drum on said cartridge frame; and a second drum shaft, which is pressed into a central portion of said second cylindrical projection, and which supports said electro-photographic photosensitive drum on said cartridge frame, wherein said second cylindrical projection is larger than said first cylindrical projection, wherein a thickness of said second cylindrical projection is greater than a thickness of said first cylindrical projection, and wherein said second drum shaft is larger in diameter than said first drum shaft.

13. A process cartridge according to claim 12, wherein one end of said first drum shaft is pressed into a central portion of said first cylindrical projection, and one end of said second drum shaft is pressed into a central portion of said second cylindrical projection.

14. A process cartridge according to claim 12, wherein said drum gear is a compound gear, a first gear portion of which meshes with said driving gear when the process cartridge is mounted to the main assembly of the electro-photographic image forming apparatus, and a second gear portion of which meshes with a transfer roller gear provided on the main assembly of the electro-photographic image forming apparatus to transmit a driving force to said transfer roller for rotating said transfer roller.

15. A process cartridge according to claim 12 or 14, wherein, when the process cartridge is mounted to the electro-photographic image forming apparatus, said first cylindrical projection and said second cylindrical projection are engaged with recesses provided in the main assembly to position the process cartridge, wherein said main assembly is provided with a first guide portion for guiding said first projection to the recess, and a second guide portion for guiding said second projection to the recess, and wherein an opening of the second guide portion, through which the second projection is to be put, is larger than an opening of the first guide portion, through which the first projection is to be put, thereby preventing said second projection from being put through the opening of the first guide portion.

16. A process cartridge according to claim 12, wherein said process cartridge comprises said electro-photographic photosensitive drum, charging means or developing means and cleaning means, as said processing means, and is detachably mountable to the main assembly of the electro-photographic image forming apparatus.

17. A process cartridge according to claim 12, wherein said process cartridge integrally comprises said electro-photographic photosensitive drum, and at least one of charging means, developing means, and cleaning means, as said processing means, and is detachably mountable to the main assembly of the electro-photographic image forming apparatus.

18. A process cartridge according to claim 12, wherein said process cartridge integrally comprises said electro-photographic photosensitive drum and charging means as said processing means, and is detachably mountable to the main assembly of the electro-photographic image forming apparatus.

19. A process cartridge according to claim 12, wherein said first cylindrical projection and said second cylindrical projection are one of entirely cylindrical and partially cylindrical.

20. An electro-photographic image forming apparatus, for forming an image on a recording material, to which a process cartridge is detachably mountable, said apparatus comprising:

a. mounting means for removably mounting a process cartridge that includes:

a cartridge frame;

an electro-photographic photosensitive drum;

processing means for acting on said electro-photographic photosensitive drum;

a first cylindrical projection projecting outwardly from one of opposite ends of said cartridge frame, and coaxially with said electro-photographic photosensitive drum;

a second cylindrical projection projecting outwardly from the other of the opposite ends of said cartridge frame, and coaxially with said electro-photographic photosensitive drum, said first cylindrical projection having a diameter that is smaller than a diameter of said second cylindrical projection;

a drum gear, which is provided at one end of said electro-photographic photosensitive drum, and meshes with a driving gear provided in a main assembly of said electro-photographic image forming apparatus to receive a driving force for rotating said electro-photographic photosensitive drum when said process cartridge is mounted in the main assembly of the electro-photographic image forming apparatus;

a first drum shaft, which is pressed into a central portion of said first cylindrical projection, and supports said electro-photographic photosensitive drum on said cartridge frame; and a second drum shaft, which is pressed into a central portion of said second cylindrical projection, and which supports said electro-photographic photosensitive drum on said cartridge frame;

b. transferring means for transferring onto the recording material a toner image formed on said electro-photographic photosensitive drum contained in said process cartridge mounted in said mounting means;

c. fixing means for fixing to the recording material a toner image, which is transferred onto the recording material by said transferring means; and d. conveying means for conveying the recording material;

wherein said second cylindrical projection is larger than said first cylindrical projection; a thickness of said second cylindrical projection is greater than a thickness of said first cylindrical projection; and said second drum shaft is larger in diameter than said first drum shaft;

wherein said mounting means comprises a first guide portion for guiding said first cylindrical projection, and a second guide portion for guiding said second cylindrical projection; and wherein a second projection insertion opening of said second guide portion is larger than a first projection insertion opening of said first guide portion.

21. An electro-photographic image forming apparatus according to claim 20, wherein said electro-photographic image forming apparatus is an electro-photographic copying machine, a laser beam printer, or a facsimile apparatus.

22. A process cartridge detachably mountable to a main assembly of an electro-photographic image forming apparatus, wherein the main assembly is provided with a first guiding portion and a second guiding portion, and the second guiding portion has an insertion opening which is larger than that of the first guiding portion, said process cartridge comprising:

a cartridge frame;

an electro-photographic photosensitive drum;

a charge roller for charging said electro-photographic photosensitive drum;

a development roller for developing a latent image formed on said electro-photographic photosensitive drum, rotatable to convey toner to said electro-photographic photosensitive drum;

a cleaning blade in contact with said electro-photographic photosensitive drum to remove toner remaining on said electro-photographic photosensitive drum;

a first cylindrical projection, which projects outwardly from one of opposite ends of said cartridge frame, coaxially with said electro-photographic photosensitive drum, and is guided by said first guide portion;

a second cylindrical projection, which projects outwardly from the other of the opposite ends of said cartridge frame, coaxially with said electro-photographic photosensitive drum, and is guided by said second guide portion;

a drum gear, which is provided at one end of said electro-photographic photosensitive drum, and which meshes with a driving gear provided on the main assembly to receive a driving force for rotating said electro-photographic photosensitive drum when said process cartridge is mounted to the main assembly of the electro-photographic image forming apparatus;

a first drum shaft, which is pressed into a central portion of said first cylindrical projection, and which supports said electro-photographic photosensitive drum on said cartridge frame; and a second drum shaft, which is pressed into a central portion of said second cylindrical projection, and which supports said electro-photographic photosensitive drum on said cartridge frame;

wherein said second cylindrical projection is larger than an opening of said first guide portion, thereby being prevented from being inserted into the opening of said first guide portion;

wherein a diameter of said second cylindrical projection is larger than a diameter of said first cylindrical projection;

wherein a thickness of said second cylindrical projection is greater than a thickness of said first cylindrical projection; and wherein said second drum shaft is larger in diameter than said first drum shaft.

23. A process cartridge according to claim 22, wherein said drum gear is a compound gear, a first gear portion of which meshes with said driving gear when the process cartridge is mounted to the main assembly of the electro-photographic image forming apparatus, and a second gear portion of which meshes with a transfer roller gear provided in the main assembly of the electro-photographic image forming apparatus to transmit the driving force for rotating said transfer roller.

24. A process cartridge according to claim 22, wherein, when the process cartridge is mounted in the electro-photographic image forming apparatus, said first cylindrical projection and said second cylindrical projection are engaged with recesses provided in the main assembly to position the process cartridge, one recess being provided in said first guide portion, and another recess being provided in said second guide portion.

25. A process cartridge according to claim 22, wherein said process cartridge integrally comprises said electro-photographic photosensitive drum, charging means or developing means and cleaning means, as said processing means, and is detachably mountable to the main assembly of the electro-photographic image forming apparatus.

26. A process cartridge according to claim 22, wherein said first cylindrical projection and said second cylindrical projection are one of entirely cylindrical and partially cylindrical.

27. An electro-photographic image forming apparatus, for forming images on a recording material, to which a process cartridge is detachably mountable, said apparatus comprising:

a. a first guide portion and a second guide portion for guiding said process cartridge, said process cartridge including:

a cartridge frame;

an electro-photographic photosensitive drum;

a charge roller for charging said electro-photographic photosensitive drum;

a development roller for developing a latent image formed on said electro-photographic photosensitive drum, rotating to convey toner to said electrophotographic photosensitive drum;

a cleaning blade in contact with said electro-photographic photosensitive drum to remove toner remaining on said electro-photographic photosensitive drum;

a first cylindrical projection, which projects outwardly from one of opposite ends of said cartridge frame, and coaxially with said electro-photographic photosensitive drum;

a second cylindrical projection, which projects outwardly from the other of the opposite ends of said cartridge frame, and coaxially with said electro-photographic photosensitive drum;

a drum gear, which is provided at one axial end of said electrophotographic photosensitive drum, and which meshes with a driving gear provided on a main assembly of said electro-photographic image forming apparatus to receive a driving force for rotating said electro-photographic photosensitive drum when said process cartridge is mounted to the main assembly of the electro-photographic image forming apparatus;

a first drum shaft, which is pressed into a central portion of said first cylindrical projection, and which supports said electro-photographic photosensitive drum on said cartridge frame; and a second drum shaft, which is pressed into a central portion of said second cylindrical projection, and which supports said electro-photographic photosensitive drum on said cartridge frame;

b. a first recess and a second recess, which engage with said first cylindrical projection and said second cylindrical projection, respectively, to fix a position of said process cartridge;

c. a transfer roller for transferring a toner image formed on said electro-photographic photosensitive drum contained in said process cartridge to the recording material;

d. a pair of rotative members for fixing on a recording material the toner image transferred onto the recording material by said transfer roller; and e. a conveyer member for conveying the recording material by rotating;

wherein said second cylindrical projection is larger than an opening of said first guide portion, thereby being prevented from being inserted into the opening of said first guide portion;

wherein a thickness of said second cylindrical projection is greater than a thickness of said first cylindrical projection;

wherein a diameter of said second cylindrical projection is larger than a diameter of said first cylindrical projection;

wherein said second drum shaft is larger in diameter than said first drum shaft; and wherein said first guide portion and said second guide portion guide said first cylindrical projection and said second cylindrical projection, respectively.

28. An electro-photographic image forming apparatus according to claim 27, wherein said electro-photographic image forming apparatus is an electro-photographic copying machine, a laser beam printer, or a facsimile apparatus.

29. A process cartridge detachably mountable to a main assembly of an electrophotographic image forming apparatus, said process cartridge comprising:

a cartridge frame;

an electrophotographic photosensitive drum;

processing means for acting on said electrophotographic photosensitive drum;

a first projection projecting outwardly from one of opposite ends of said cartridge frame, and coaxially with said electrophotographic photosensitive drum; and a second projection projecting outwardly from the other of said opposite ends of said cartridge frame, and coaxially with said electrophotographic photosensitive drum, wherein a dimension of said second projection measured in a direction perpendicular to a longitudinal direction of said photosensitive drum is larger than that of said first projection.

30. A process cartridge according to claim 29, wherein said first and second projections are cylindrical, and a diameter of said second projection is larger than that of said first projection.

31. A process cartridge according to claim 29, wherein a driving force receiving member is mounted at one end of said electrophotographic photosensitive drum, and wherein, when said process cartridge is mounted to the main assembly of the electrophotographic image forming apparatus, said driving force receiving member meshes with a driving force transmitting member provided in the main assembly to receive a driving force for rotating said electrophotographic photosensitive drum.

32. A process cartridge according to claim 31, wherein said driving force receiving member is a compound gear, a first gear portion of which meshes with the driving gear when said process cartridge is mounted to the main assembly of the electrophotographic image forming apparatus, and a second gear portion of which meshes with a transfer roller gear provided in the main assembly of the electrophotographic image forming apparatus to transmit a driving force to the transfer roller for rotating the transfer roller.

33. A process cartridge according to claim 29, wherein a thickness of a cylindrical wall of said second projection is greater than a thickness of a cylindrical wall of said first projection.

34. A process cartridge according to claim 29 or 33, wherein one end of a first drum shaft, for supporting said electrophotographic photosensitive drum, is pressed into a central portion of said first projection and one end of a second shaft, for supporting said electrophotographic photosensitive drum, is pressed into a central portion of said second projection, and wherein said second drum shaft is larger in diameter than said first drum shaft.

35. A process cartridge according to claim 29, wherein, when said process cartridge is mounted to the electrophotographic image forming apparatus, said first projection and said second projection are engaged with recesses provided in the main assembly to position said process cartridge, wherein the main assembly is provided with a first guide groove portion for guiding said first projection to the recess, and a second guide groove portion for guiding said second projection to the recess, and wherein an entering opening of said second guide groove portion, through which said second projection is to be put, is larger than an entering opening of said first guide groove portion, through which said first projection is to be put, thereby preventing said second projection from being put through the entering opening of the first guide portion.

36. A process cartridge according to claim 29, wherein said process cartridge integrally comprises said electrophotographic photosensitive drum, and at least one of a charging member, a developing member, and cleaning member, as said processing means, and is detachably mountable to the main assembly of the electrophotographic image forming apparatus.

* * * * *

UNITED STATES PATENT AND TRADEMARK OFFICE

CERTIFICATE OF CORRECTION

PATENT NO. : 5,907,751

DATED : May 25, 1999

INVENTORS : HIDESHI KAWAGUCHI, ET AL.

It is certified that error appears in the above-identified patent and that said Letters Patent is hereby corrected as shown below:

Column 1

Line 35, "form" should read --from--.
Line 41, "guides" should read --guide--.

Column 8

Line 54, "of" should be deleted.

Column 9

Line 21, "applicable," should read --applicable--.

Signed and Sealed this

Twenty-fifth Day of January, 2000

*Attest:*

*Attesting Officer*

*Acting Commissioner of Patents and Trademarks*